US009210974B2

(12) United States Patent
Krakauer

(10) Patent No.: US 9,210,974 B2
(45) Date of Patent: Dec. 15, 2015

(54) GARMENT CARRIER SYSTEM

(75) Inventor: Karol Ann Krakauer, Fort Collins, CO (US)

(73) Assignee: COAT CARRIERS BY KAROL ANN, LLC, Fort Collins, CO (US)

( * ) Notice: Subject to any disclaimer, the term of this patent is extended or adjusted under 35 U.S.C. 154(b) by 300 days.

(21) Appl. No.: 12/317,551

(22) Filed: Dec. 23, 2008

(65) Prior Publication Data

US 2009/0184011 A1 Jul. 23, 2009

Related U.S. Application Data

(60) Provisional application No. 61/021,806, filed on Jan. 17, 2008.

(51) Int. Cl.

| | |
|---|---|
| ***B65D 85/20*** | (2006.01) |
| ***A45C 3/00*** | (2006.01) |
| *A45C 13/10* | (2006.01) |
| *A45C 13/30* | (2006.01) |

(52) U.S. Cl.

CPC ..... *A45C 3/004* (2013.01); *A45C 2013/1015* (2013.01); *A45C 2013/306* (2013.01)

(58) Field of Classification Search

CPC .... B65D 85/18; B65D 85/182; A61B 19/045; A47G 25/54; A45C 3/12

USPC ..... 206/278, 293, 446, 373, 5; 224/153, 224/223, 250, 575, 576, 661; 190/107, 1; 602/20, 21, 23

See application file for complete search history.

(56) References Cited

U.S. PATENT DOCUMENTS 2,058,474 A 10/1936 Long
3,442,270 A * 5/1969 Steinman ..... A61F 13/00021 128/DIG. 15
3,612,260 A 10/1971 Brillhart
3,743,083 A 7/1973 James
3,809,194 A 5/1974 Chappelle et al.
3,881,579 A 5/1975 Keerdoja
4,351,066 A 9/1982 Pearsall
4,390,087 A 6/1983 Goldfinger
4,467,477 A 8/1984 DeGennaro
4,489,815 A * 12/1984 Martinez ..... A45C 9/00 190/1
4,527,566 A * 7/1985 Abare ..... A61F 7/02 601/15
4,563,776 A 1/1986 Boesen
4,620,396 A * 11/1986 Bjorntwedt ..... B65D 75/14 383/4
4,682,691 A * 7/1987 Spiering ..... B25H 3/00 206/373
4,817,791 A 4/1989 Adams
4,967,986 A * 11/1990 Schildkraut ..... A45C 3/10 224/223
5,287,571 A * 2/1994 Rademacher ..... A47G 9/086 190/2
5,448,790 A * 9/1995 Saro ..... A47C 17/045 5/427
5,564,125 A 10/1996 Waldman et al.
5,628,398 A 5/1997 Jackson
5,884,737 A 3/1999 Cabo
6,199,232 B1 * 3/2001 Kocivar ..... A47G 9/0207 2/69.5
6,332,222 B1 12/2001 Graham
6,431,420 B1 * 8/2002 Cragg ..... A45F 5/00 224/222

(Continued)

OTHER PUBLICATIONS

U.S. Appl. No. 61/021,806, filed Jan. 17, 2008.

*Primary Examiner* — Fenn Mathew
*Assistant Examiner* — Cynthia Collado
(74) *Attorney, Agent, or Firm* — Craig R. Miles; CR Miles P.C.

(57) ABSTRACT

A garment carrier which provides a flexible material having a fastener with matable parts capable of engagement when a garment is rolled within the flexible material.

22 Claims, 5 Drawing Sheets

(56) References Cited

U.S. PATENT DOCUMENTS 6,513,692 B1 * 2/2003 Forgosh ..... A45C 13/1053
224/237
6,656,210 B1 * 12/2003 Plewes ..... A61F 7/02
128/DIG. 15
D497,826 S * 11/2004 Nelson ..... D11/3
D520,565 S * 5/2006 Gonzales ..... D19/89
7,811,649 B2 * 10/2010 Post ..... A47L 13/20
206/820
2002/0112278 A1 * 8/2002 Phillips ..... A41D 13/05
2/455
2005/0035616 A1 * 2/2005 Davies ..... A45F 3/02
294/149
2006/0150297 A1 7/2006 Turner
2008/0039755 A1 * 2/2008 Phillips ..... A61F 5/0104
602/20

* cited by examiner

GARMENT CARRIER SYSTEM

This United States Non-Provisional Patent Application claims the benefit of U.S. Provisional Patent Application No. 61/021,806, filed Jan. 17, 2008, hereby incorporated by reference in the entirety herein.

I. BACKGROUND

A garment carrier which provides a flexible material having a fastener with matable parts capable of engagement when a garment is rolled within the flexible material.

Over garments such as coats, sweaters, sweatshirts, suit coats, or the like are often removed when a person enters a temperature controlled environment such as a transportation terminal such as an airport terminal or bus terminal. When the person removes the over garment, the garment may be held by person or set aside. The removed garment whether held or set aside can become soiled, damaged or stolen. Additionally, when removed carrying the garment can be an inconvenience because of the size of the garment or because a plurality of garments are removed and carried.

Conventional garment carriers typically provide a fixed external configuration into which a garment can be placed for storage or transportation such as suitcases or garment bags. Suitcases or garment bags may not be readily available once checked, may be difficult to open to receive a single garment for storage, and may not reconfigure to a sufficiently small size to be carried on the person.

The inventive garment carrier described herein addresses each of these problems.

II. SUMMARY OF THE INVENTION

A garment carrier which provides a flexible material having mateable parts of a fastener capable of mateable engagement when a garment is rolled within the flexible material.

Accordingly, a broad object of the invention can be to provide a garment carrier which can be readily carried on the person of a user and conveniently reconfigured to receive and secure a garment.

A second broad object of the invention can be to provide a garment carrier which variably adjusts volume in correspondence to the received garment volume.

A third broad object of the invention can be to provide a configuration of mateable parts of a fastener capable of a continuous fastening range through the normal operational range of the garment carrier. A continuous fastening range avoids having a plurality of discrete fastening locations such as provided by a belt which provides a plurality of apertures spaced a distance apart into which a hasp inserts or a single fastening location in the form of a latch or zipper.

A fourth broad object of the invention can be to provide a garment carrier which receives a garment in an unrolled condition of the garment carrier and reconfigures to a rolled condition in which the garment is secured by mateable engagement of a fastener.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

A garment carrier which provides a flexible material having a fastener with matable parts capable of engagement when a garment is rolled within the flexible material.

Figure 1:
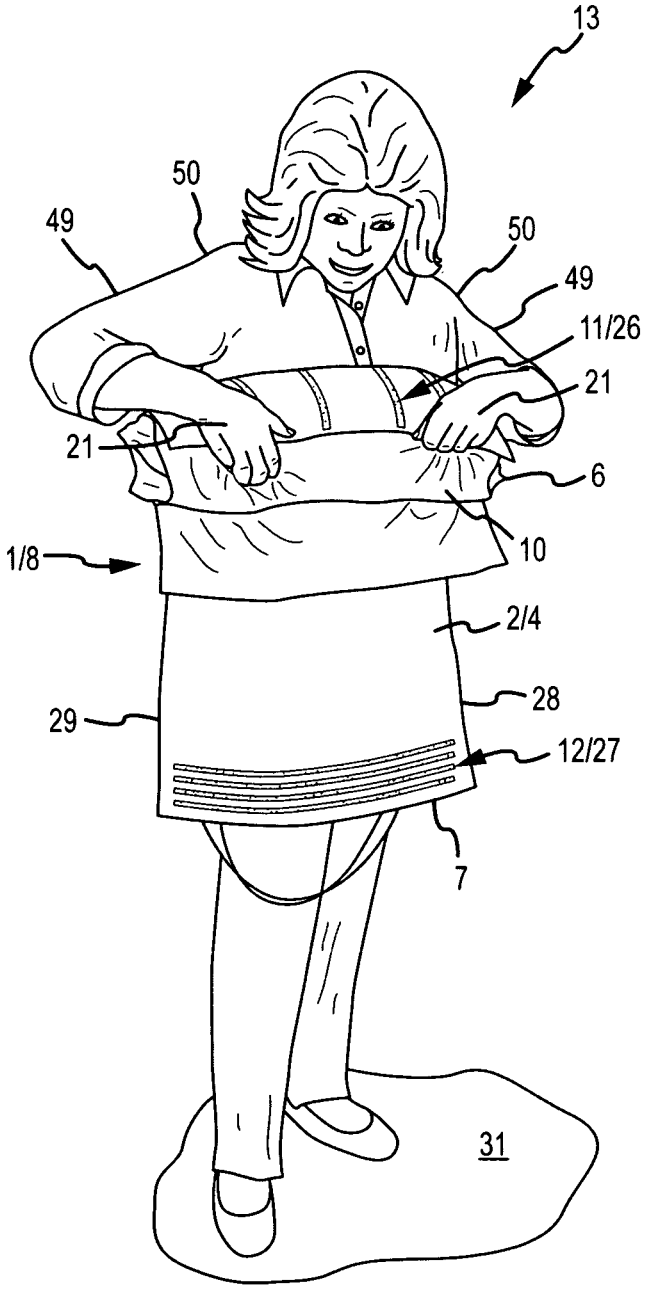
FIG. 1 is an illustration of a particular method of using a particular embodiment of the inventive garment carrier in the unrolled condition to receive a garment.
Figure 2:
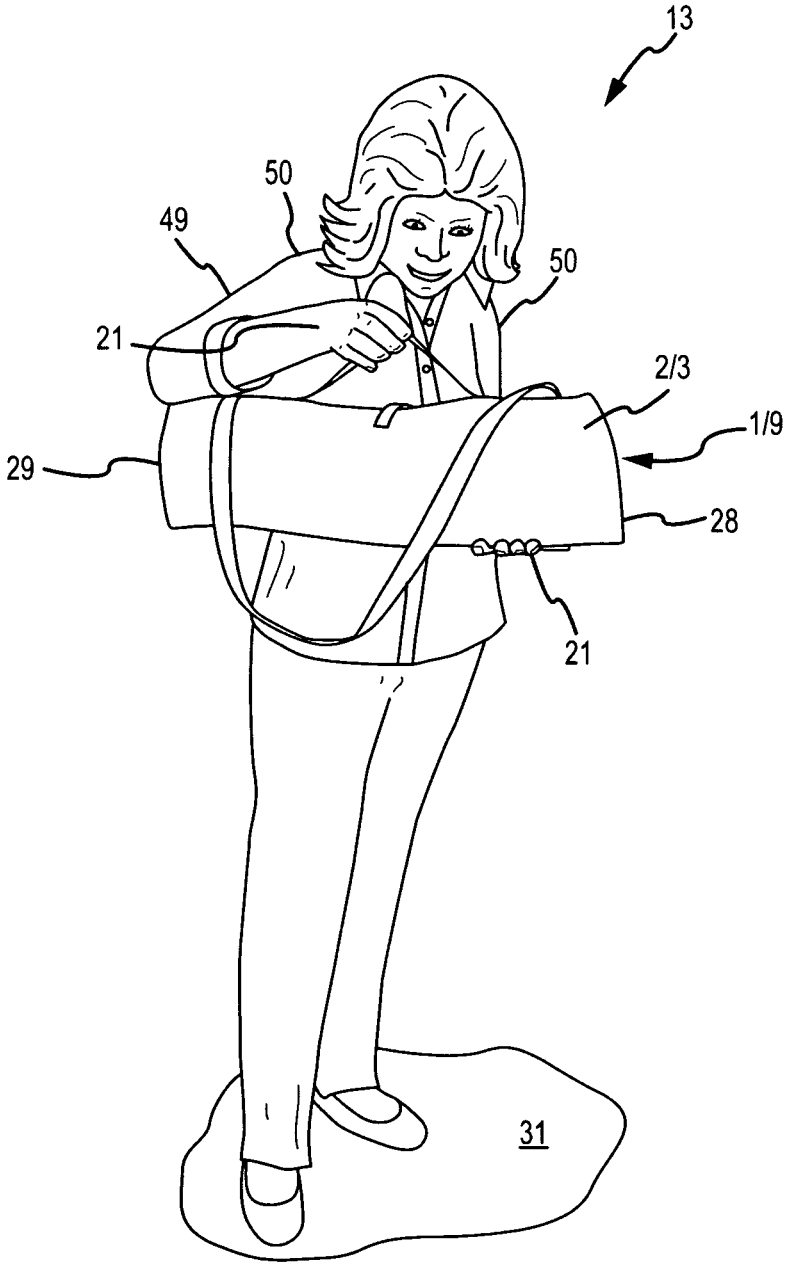
FIG. 2 is an illustration of a particular method of using a particular embodiment of the inventive garment carrier in the rolled condition to store a garment.

Referring primarily to FIGS. 1 and 2, a particular method of carrying a garment in an inventive garment carrier (1) is shown. A flexible material (2) can be provided having a thickness disposed between a first material surface (3) and a second material surface (4) and a material length (5) disposed between a first material end (6) and a second material end (7) capable of reconfiguration between an unrolled condition (8)(as shown for example in FIG. 1) and a rolled condition (9) (as shown for example in FIG. 2). The flexible material (2) can be established in the unrolled condition (8) and a garment (10) can be located on the second material surface (4) proximate the first material end (6). The flexible material (2) can be rolled about the garment (10) located on the second material surface (2) proximate the first material end (6) from the first material end (6) toward the second material end (7) of the flexible material (2). Mateable parts of a first fastener element (11) secured to the first material surface (3) proximate the first material end (6) of the flexible material (2) and a second fastener element (12) secured to the second material surface (4) proximate the second material end (7) of the flexible material (2) can be engaged to fasten the first material surface (3) of the flexible material (2) to the second material surface (4) of the flexible material (2) to generate the rolled condition (9) of the flexible material (2). The garment (10) can be carried within the flexible material (2) in the rolled condition (9) by a user (13) of the garment carrier (1).

Figure 3:
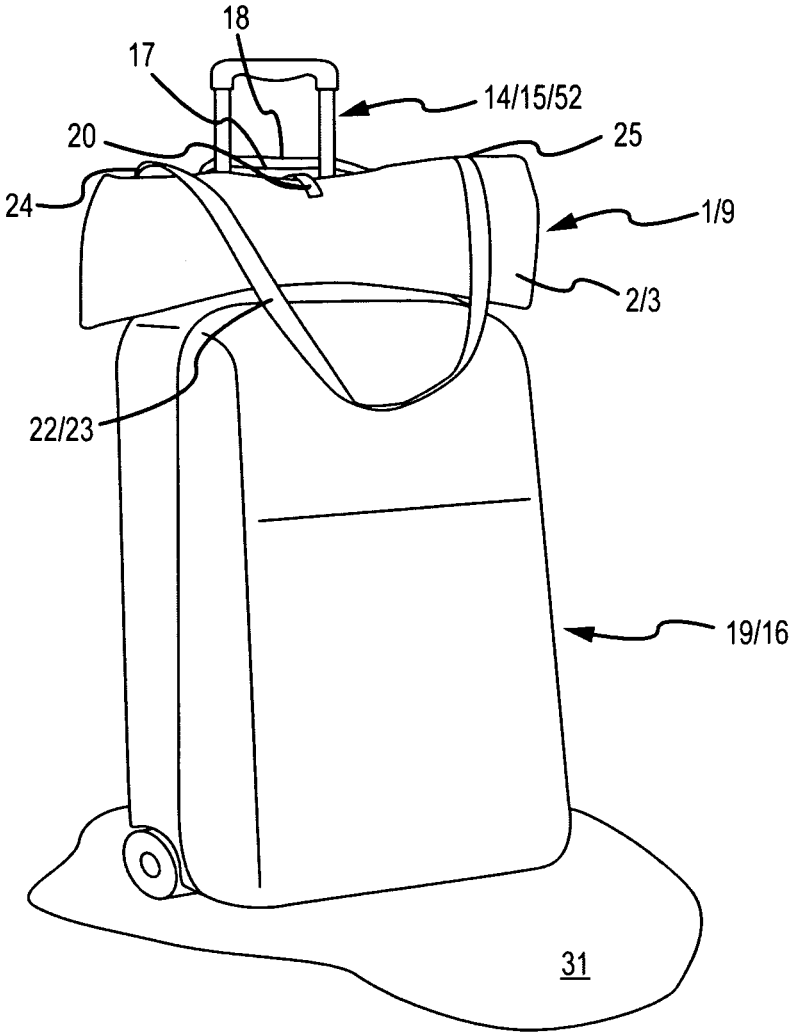
FIG. 3 is an illustration of a particular method using a particular embodiment of the inventive garment carrier in the rolled condition to transport a garment.

Now referring primarily to FIG. 3, as to certain embodiments of the method of carrying a garment (10), a support member (14) such as a grippable member (15) of a suitcase (16) can pass through a handle opening (17) generated by coupling a handle (18) to the first material surface (3) proximate the second material end (7). The user (13) can then engage the support member (14) to generate movement in an attached object (19)(for example engage the grippable member (15) of a suitcase (16) to generate movement in the attached suitcase (16)) which carries the flexible material (2) with the garment (10) in the rolled condition (9)(or can carry the unrolled condition (8)) of the flexible material (3)). Alternately, a releaseably closable loop (20) coupled to the first material surface (3) of the flexible material (2) proximate the second material end (7) can be closed about the grippable member (15) of the attached object (19) to secure the flexible material (2) with the garment (10) in the rolled condition (9) to the grippable member (15) or other part of the attached object (19). Understandably, a hand (21) of a user (13) can engage the above-described handle (18) to carry the flexible material (2) in the rolled condition (9)(see FIG. 2 as an example).

Again referring primarily to FIG. 3, as to certain embodiments of the method of carrying a garment (10), a shoulder strap (22) having a strap length (23) disposed between a first strap end (24) and a second strap end (25) each coupled to the first material surface (3) of the flexible material (2) proximate the second material end (7) can be engaged with the shoulder (50) of the user (13) to carry the flexible member (2) in the rolled condition (9).

Now referring primarily to FIG. 1, as to certain embodiments of the method of carrying a garment (10), the step of engaging mateable parts of the first fastener element (11) secured to said first material surface (3) proximate the first material end (6) of the flexible member (3) and a second fastener element (12) secured to said second material surface (4) proximate said second material end (7) of the flexible material (2) to fasten the first material surface (3) of the flexible material (2) to the second material surface (4) of the flexible material (2) to generate the rolled condition (9) can as one non-limiting example be the step of engaging mateable parts of a loop material (26) secured to the first material surface (3) proximate the first material end (6) of the flexible material (2) and a hook material (27) secured to the second material surface (4) proximate the second material end (7) of the flexible material (2) to fasten the first material surface (3) of the flexible material (2) to the second material surface (4) of the flexible material (2) to generate the rolled condition (9). As to certain embodiments of the method, a plurality of strips of loop material (26) secured to the first material surface (3) of the flexible material (2) in substantially parallel relation laterally spaced a distance apart between a first material side (28) and a second material side (29) of the flexible material (2) can correspondingly engage a plurality of strips of hook material (27) secured to the second material surface (4) of the flexible material (2) in substantially parallel relation longitudinally spaced a distance apart between the second material end (7) and about one half the distance to the first material end (6) of the flexible material (2). With respect to certain embodiments of the method, engagement of the plurality of strips of hook material (27) with the plurality of strips of loop material (26) can be in substantially perpendicular relation to fasten the first material surface (3) of the flexible material (2) to the second material surface (4) of the flexible material (2) to establish the rolled condition (9).

The term "garment" used in the particular non-limiting examples of the method above-described is intended to broadly encompass any article which can be located on the second material surface (4) proximate the first material end (6) and allows the flexible material (2) to be rolled from the first material end (6) toward the second material end (7). As non-limiting examples, the term "garment" includes coats, sweaters, shirts, sweatshirts, pants, socks, shoes, ties, other articles of clothing, or the like and can also include lap top computers, purses, makeup bags, books, magazines, newspapers, packages, or the like.

The term "user" used in the particular non-limiting examples of the method above-described is intended to broadly encompass any person capable of performing any embodiment of the method of carrying a garment as above-described.

Now referring primarily to FIGS. 4-7, embodiments of the inventive garment carrier (1) can include a flexible material (2) having a thickness disposed between a first material surface (3) and a second material surface (4) and a material length (5) disposed between a first material end (6) and a second material end (7) capable of reconfiguration between an unrolled condition (8) and a rolled condition (9). As to particular non-limiting embodiments of the inventive garment carrier (1), the flexible material (2) can have a material length (5) of about twenty-eight inches disposed between the first material end (6) and the second material end (7) and a material width (30) of about twenty one inches disposed between a first material side (28) and a second material side (29), although the dimensional relation between the material length (5) and material width (30) can be altered based on the particular application to afford a numerous and wide variety of configurations of the flexible material (2) which can be used with a correspondingly numerous and varied methods of carrying a garment (10). Typically, the material length (5) will be in a range of about twenty five inches to about thirty five inches and the material width (30) will be in a range of about fifteen inches and about twenty five inches. The flexible material (2) can be generated from varied and numerous materials such as plastic sheet, or plastic woven strands or fibers such as nylon, polyester, vinyl, or the like, non-plastic sheet, or non-plastic woven strands or fibers, such as metal, cotton, flax, hemp, rayon, silk, or the like will allow reconfiguration from the rolled condition (9) to the unrolled condition (8). The unrolled condition (8) includes any condition of the flexible material (2) which allows a garment (10) to be located on the second material surface (4) proximate the first material end (6). As one non-limiting example, the flexible material (2) can be laid in substantially flat unfolded condition on a support surface (31) such as the ground or a floor (see FIG. 1) or can be held proximate the first material end (6) allowing gravity to establish the flexible material (2) in a substantially flat unfolded condition, as shown in FIG. 1. The rolled condition (9) includes any condition in which the first material end (6) is rolled a sufficient distance toward the second material end (7) to allow engagement of the mateable parts of the first fastener element (11) the second fastener element (12), as above-described. The rolled condition (9) can further include a garment (10) as above-defined about which the flexible material (2) can be rolled. The rolled condition (9) can have a lesser or greater circumference depending on the type and dimensional relations of the flexible material (2) and the configuration of the garment (10) rolled inside the flexible material (2), if any.

Again primarily referring to FIGS. 4-7, embodiments of the inventive garment carrier (1) can further include a fastener (38) having a first fastener element (11) secured to the first material surface (3) proximate the first material end (6) of the flexible member (2) and a second fastener element (12) secured to the second material surface (4) proximate the second material end (7) of the flexible material (2). The mateable parts of the first fastener element (11) and of the second fastener element (12) can fasten the first material surface (3) of the flexible material (2) to the second material surface (4) of the flexible material (2) in the rolled condition (9).

Figures 4, 7:
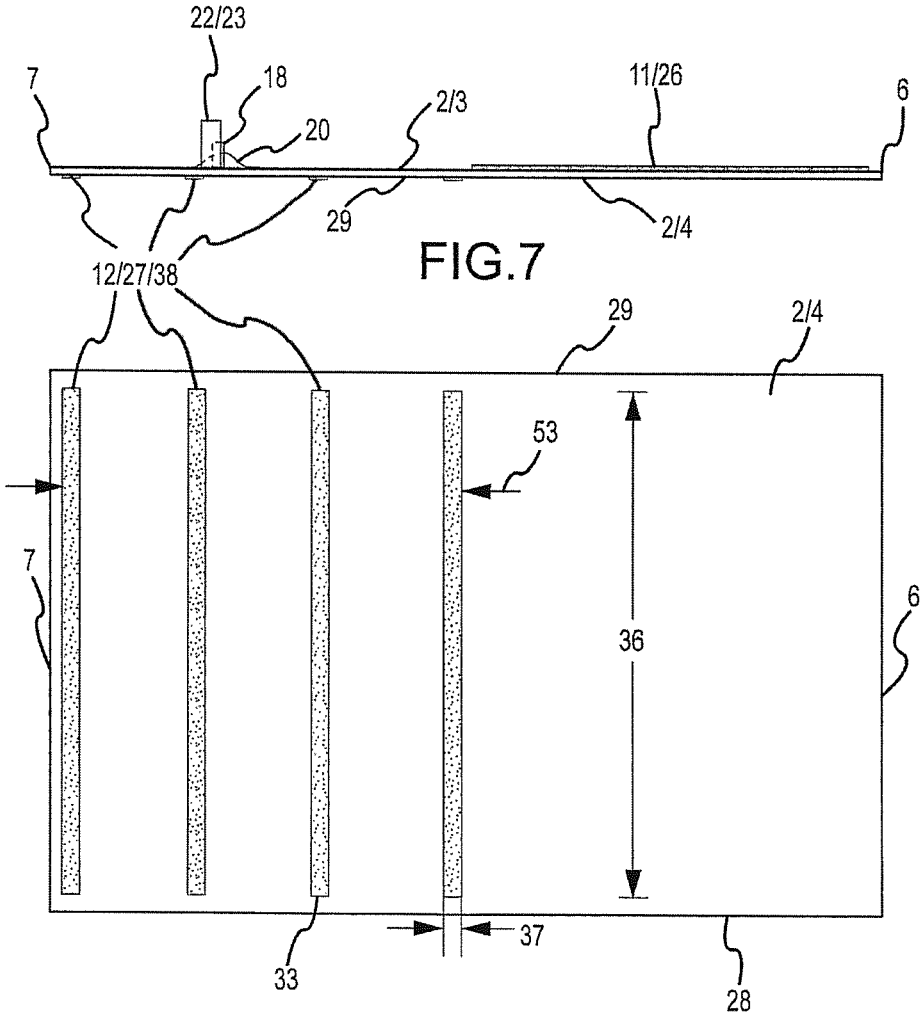
FIG. 4 is second material surface view of a particular embodiment of the inventive garment carrier.
FIG. 7 is side view of a particular embodiment of the inventive garment carrier.
Figure 6:
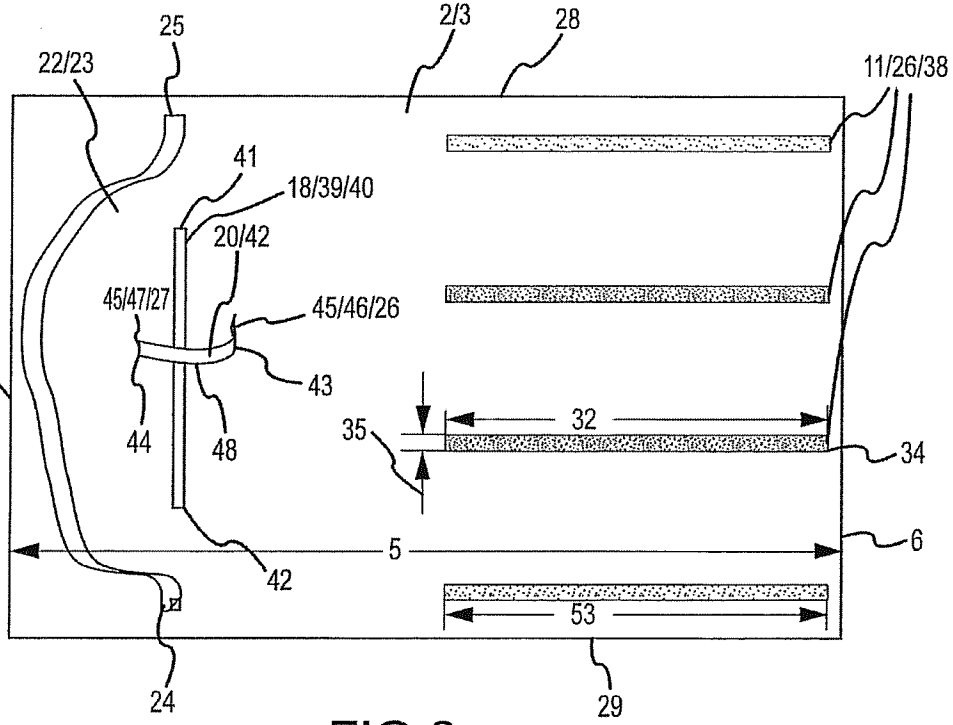
FIG. 6 is a first material surface view of a particular embodiment of the inventive garment carrier.

Now primarily referring to FIGS. 4 and 6, as to certain embodiments of the inventive garment carrier (1), the first fastener element (11) can be a loop material (26) secured to the first material surface (3) proximate the first material end (6) of said flexible material (2) and the second fastener element (12) can be a hook material (27) secured to the second material surface (4) of the flexible material (2) proximate the second material end (7) of the flexible material (2). The hook material (27) can be a piece of fabric covered with a plurality of discrete hooks. The loop material (26) can be a piece of fabric covered with a plurality of discrete loops. When the hook material (27) and the loop material (26) are engaged, the hooks catch in the loops and secure the hook material (27) to the loop material (26). VELCRO® is a brand name of a particular hook-and-loop fastener suitable for use with the inventive garment carrier, although the invention is not so limited.

Now referring primarily to FIG. 6, as to certain embodiments of the inventive garment carrier system (1), the loop material (26) secured to said first material surface (3) proximate the first material end (6) of the flexible material (2) can be in the form of a plurality of strips of loop material (26) arranged in substantially parallel relation laterally spaced a distance apart between a first material side (28) and a second material side (29) of the flexible material (2). As a non-limiting example, a plurality of strips of loop material (26) can be secured to the first material surface (3) of the flexible material (2) in substantially parallel relation laterally spaced a distance apart between a first material side (28) and a second material side (29) of the flexible material each having a loop material length (32) in a range of about ten inches and about twenty inches disposed between a first loop material end (33) and a second loop material end (34) and a loop material width (35) in a range of about three-quarters of an inch and about two inches.

Now referring primarily to FIG. 4, as to certain embodiments of the inventive garment carrier system (1), the hook material (27) secured to said second material surface (4) proximate the second material end (7) of the flexible material (2) can be in the form of a plurality of strips of hook material (27) arranged in substantially parallel relation longitudinally spaced a distance apart between the first material end (6) and the second material end (7) of the flexible material (2). As a non-limiting example, a plurality of strips of hook material (27) can be secured to the second material surface (4) of the flexible material (2) in substantially parallel relation longitudinally spaced a distance apart between the second material end (7) and about one half the distance to the first material end (6) of the flexible material (2) each of the plurality of strips of hook material (27) can have a hook material length (36) about equal to the distance between the first material side (28) and the second material side (29) of the flexible material (2) and a hook material width (37) in a range of about three-quarters of an inch and about two inches.

In the above example, when the hook material (27) and the loop material (26) are secured to the first material surface (3) and the second material surface (4) in substantially parallel relation as described, the plurality of strips of loop material (26) and the plurality of strips of hook material (27) can engage in substantially perpendicular relation in the rolled condition (9) of the flexible material (2) to fasten the first material surface (3) of the flexible material (2) to the second material surface (4) of the flexible material (2). As shown in FIGS. 1, 4 and 6.

Now primarily referring to FIGS. 4-7, one non-limiting example of the garment carrier (1) as above-described can include a flexible material (2) disposed between the first material end (6) and the second material end (7) having a material length (5) of about twenty-eight inches and the flexible material (2) disposed between the first material side (28) and the second material side (29) can have a material width (30) of about twenty one inches with a plurality of strips of loop material (26) secured to the first material surface (3) of the flexible material (2) in substantially parallel relation laterally spaced a distance apart between the first material side (28) and the second material side (29) of the flexible material (2) in the form of four strips each having a loop material length (32) of about fifteen inches disposed between a first loop material end (33) and a second loop material end (34) and each of the plurality of strips of loop material (26) can have a loop material width (35) of about one and one-half inches and each first loop material end (33) can have a location within about one inch of the first material end (6) of the flexible material (2), and the plurality of strips of hook material (27) can be secured to the second material surface (4) of the flexible material (2) in substantially parallel relation longitudinally spaced a distance apart in the form of four strips of hook material (27) spaced about three inches apart between the second material end (7) and about one half the distance to the first material end (6) of the flexible material (2) each having a hook material length (36) about equal to the distance between the first material side (28) and the second material side (29) of the flexible material (2) and a hook material width (37) of about one and one-half inches. While this particular embodiment of the inventive garment carrier (1) has the specific dimensional relation between the elements described, it is not intended that the invention be limited to this particular embodiment of the invention. Rather this particular example is intended to be illustrative of the numerous and varied embodiments of the invention that can be made and used by a person of ordinary skill in the art.

Also, while the particular embodiments of the inventive garment carrier (1) above-described include a fastener (38) having mateable parts which comprise a hook material (26) mateable with loop material (27) the invention is not so limited and the mateable parts of the fastener (38) can be any manner of first fastener element (11) and second fastener element (12) that when assembled can maintain the flexible material (2) in the rolled condition (9) such as a clasp, or the like. However, when a plurality of strips of hook material (27) and a plurality of strips of loop material (26) are secured to the first material surface (3) and the second material surface (4) as above-described the loop material (26) can receive the hook material (27) regardless of the circumference of the rolled condition (9) of the flexible material (2) affording a continuous fastening range (53) in which the hook material (27) can mate with the loop material (26) through the normal range of circumference of the rolled condition (9). For example, regardless of the configuration of the garment or object (10) about which the flexible material (2) can be rolled resulting in a greater or lesser circumference of the rolled condition (9), the hook material (27) can engage the loop material (26) to fasten the first material surface (3) to the second material surface (4). These particular embodiments of the garment carrier (1) function in this manner dependent upon the relation of the respective mateable parts of the fastener (38) in the form of a hook material (26) and a loop material (27).

Figure 5:
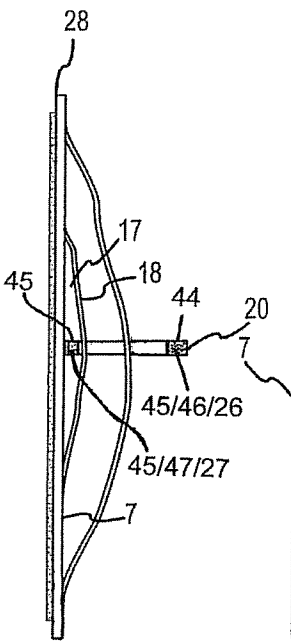
FIG. 5 is second material end view of a particular embodiment of the inventive garment carrier.

Now referring primarily to FIGS. 5, 6 and 7, the inventive garment carrier (1) can further include a handle (18) coupled to the first surface of the flexible material (2) proximate the second material end (7). As a non-limiting example, the handle (18) can take the form of a flexible band (39) having a band length (40) disposed between a pair of band ends (41) each of the pair of band ends (41) coupled to the first material surface (3) of the flexible material (2) proximate the second material end (7) with a the band length (40) sufficient to define a handle opening (17) through which a support member (14) can pass as above-described. However, the handle (18) is not limited in form to a flexible band (39) and can as an additional example can be a rigid handle having a grip element disposed between a pair leg members each leg member extending outwardly a distance to terminate in a leg end coupled to the first material surface (3). Each leg member can, but need not, have sufficient length to establish the handle opening (17) through which a support member (14) can pass. As but one alternative, the handle (18) can be configured to be gripped by a hand (21) of the user (13) whether in the form of a flexible band (39) or as a rigid handle, or other handle configuration.

Again referring to FIGS. 5, 6, 7, the inventive garment carrier (1) can further include a releaseably closable loop (20) coupled to the first material surface (3) of the flexible material (2) proximate the second material end (7). As to certain embodiments the releasably closable loop (20) can include a flexible member (42) disposed between a first flexible member end (43) and a second flexible member end (44) each correspondingly coupled to the first material surface (3) of the flexible material (2) proximate the second material end (7). A loop closure (45) can be coupled to the flexible member (42) which includes a first loop closure element (46) coupled proximate the first flexible member end (43) and a second loop closure element (47) coupled proximate the second flexible member end (44) such that mateable parts of said first loop closure element (46) and the second loop closure element (47) fasten to generate a loop opening (48). The mateable parts of the loop closure (45) can be disengage to allow the first flexible member end (43) and the second flexible member end (44) to surround a part of a support member (14) and re-engaged to secure the releasably closable loop (20) about the support member (14). One non-limiting example of the mateable parts of the loop closure (20) provides that the first loop closure element (46) can be a loop material (26) secured proximate the first flexible member end (43) and the second loop closure element (47) can be a hook material (27) secured proximate the second flexible member end (44). The loop material (26) and the hook material (27) can be in the form above-described. The mateable parts of the loop closure (45) can also take the form of a clasp which fastens the first flexible member end (43) to the second flexible member end (44), or other closure means which can operate to fasten the first flexible member end (43) to the second flexible member end (44). Alternately, a support member (14) can be passed through the loop opening (48). Embodiments of the garment carrier (1) can supported by the support member (14) rather than carried by the user (13), as above described.

Now primarily referring to FIGS. 5, 6, and 7, the inventive garment carrier (1) can further include a shoulder strap (22) having a shoulder strap length (23) disposed between first shoulder strap end (24) and a second shoulder strap end (25) each coupled to the first material surface (3) of the flexible material (2) proximate the second material end (7). The shoulder strap length (23) can be lesser or greater in a range which allows the arm (49) of a user (13) to pass through a shoulder strap opening (51) such that the shoulder strap (22) can be receivingly engaged with the shoulder (50) of the user (13).

Now primarily referring to FIG. 3, a suit case (16) is shown having an extendably retractable handle (52) passed through the garment carrier (1) handle opening (17) established by the handle (18) attached to the garment carrier (1). The retractable handle (42) of the suitcase (16) provides one non-limiting example of a support member (14) used as above-described; however, the support member (14) can be any manner of member which extends a sufficient length outwardly to pass through the handle opening (17). By supporting the garment carrier (1) on a support member (14) such as the extendably retractable handle (52) of the suitcase (16), the garment carrier can travel along with the object (19) attached to the support member (14) with out the user (13) gripping the garment carrier (1).

Again primarily referring to FIGS. 4, 5, 6 and 7, embodiments of the garment carrier (1) can be made by providing a flexible material (2) having a thickness disposed between a first surface (3) and a second material surface (4) and a material length (5) disposed between a first material end (6) and a second material end (7), the flexible material (2) capable of reconfiguration between an unrolled condition (8) and a rolled condition (9), above described and by providing a fastener (38) including a first fastener element (11) secured to the first material surface (3) proximate the first material end (6) of the flexible member (2) and a second fastener element (12) secured to the second material surface (4) proximate the second material end (7) of the flexible material (2) wherein mateable parts of the first fastener element (11) and the second fastener element (12) are capable of fastening the first material surface (3) of the flexible material (2) to the second material surface (4) of said flexible material (2) in said rolled condition (8). The step of providing a fastener (38) can comprise the steps of securing a loop material (26) to the first material surface (3) of the flexible material (2) proximate the first material end (6) and securing a hook material (27) to the second material surface (4) of the flexible material (2 proximate the second material end (7). As to certain embodiments of making a garment carrier, the step of securing a loop material (26) to the first material surface (3) can comprise the step of coupling a plurality of strips of loop material (26) to the first material surface (3) of said flexible material (2) in substantially parallel relation laterally spaced a distance apart between a first material side (28) and a second material side (29) of the flexible material (2). The step of securing a hook material (27) to the second material surface (4) can comprise the step of coupling a plurality of strips of hook material (27) to the second material surface (4) of the flexible material (2) in substantially parallel relation longitudinally spaced a distance apart between the second material end (7) and about one half the distance to the first material end (6) of the flexible material (2). The step of coupling a plurality of strips of loop material (26) can further include the step of providing the plurality of strips of loop material (26) having a loop material length (32) in a range of about ten inches and about twenty inches disposed between a first loop material end (33) and a second loop material end (34) and further providing a loop material width (35) of the plurality of strips of loop material (26) in a range of about three-quarters of an inch and about two inches. The step of coupling a plurality of strips of hook material (27) can further include the step of providing a hook material length (36) of the plurality of strips of hook material (27) about equal to the distance between the first material side (28) and the second material side (29) of the flexible material (2) and each of the plurality of strips of hook material (27) and further providing a hook material width (37) in a range of about three-quarters of an inch and about two inches.

The method of making a garment carrier can further include the step of coupling a handle (18) to the first material surface (3) of the flexible material (2) proximate the second material end (7) which as to some embodiments establish a handle opening (17) of sufficient size to receive a support member (14). The step of coupling a handle (18) to the first material surface (3) can comprise the step of providing a flexible band (39) having a band length (40) disposed between a pair of band ends (41) each coupled to the first material surface (3) of the flexible material (2) proximate the second material end (7), wherein the band length (40) of the flexible band (39) is sufficient to define the handle opening (17) through which a support element (14) can pass.

Certain embodiments of making a garment carrier (1) can further include the step of coupling a releasably closable loop (20) to the first material surface (3) of the flexible material (2) proximate the second material end (7). The step of coupling a releasably closable loop (20) can include the steps of providing a flexible member (42) disposed between a first flexible member end (43) and a second flexible member end (44) and coupling the first flexible member end (43) to the first material surface (3) of the flexible material (2) proximate the second material end (7) and providing a loop closure (45) having a first loop closure element (46) coupled proximate the first flexible member end (43) and a second loop closure element (47) coupled proximate the second flexible member end (44), and wherein mateable parts of said first loop closure element (46) and the second loop closure element (47) fasten to generate a loop opening (48). Certain embodiments of the step of providing a loop closure (45) having a first loop closure element (46) and a second loop closure element (47) comprise the step of providing a first loop closure element (46) of a loop material (26) and a second loop closure element (47) of a hook material (27).

As one non-limiting example of making a garment carrier (1) the step of providing a flexible material (2) disposed between a first flexible material end (6) and a second flexible material end (7) comprises the step of providing a flexible material (2) having a flexible material length (5) of about twenty-eight inches disposed between the first material end (6) and the second material end (7) and a flexible material width (30) of about twenty one inches disposed between said first material side (28) and said second material side (29), and wherein the plurality of strips of loop material (26) secured to the first material surface (3) of the flexible material (2) in substantially parallel relation laterally spaced a distance apart between said first material side (28) and said second material side (29) of the flexible material (2) comprise four strips each having a loop material length (36) of about fifteen inches disposed between a first loop material end (33) and a second loop material end (34) and a loop material width (35) of about one and one-half inches each first loop material end (33) having a location within about one inch of the first material end (6) of the flexible material (2), and wherein the plurality of strips of hook material (27) secured to the second material surface (4) of the flexible material (2) in substantially parallel relation longitudinally spaced a distance apart comprise four strips of hook material (27) spaced about three inches apart between the second material end (7) and about one half the distance to the first material end (6) of the flexible material (2) each having a hook material length (36) of about equal to the distance between the first material side (28) and the second side (29) of the flexible material (2) and a hook material width (37) of about one and one-half inches.

As can be easily understood from the foregoing, the basic concepts of the present invention may be embodied in a variety of ways. The invention involves numerous and varied embodiments of an inventive garment carrier and methods of making and using a garment carrier.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference. The term "about" for the purposes of this invention means in the immediate neighborhood of: NEAR.

Thus, the applicant(s) should be understood to claim at least: i) each of the garment carriers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A garment carrier, comprising:

a) a flexible material having a thickness disposed between a first material surface and a second material surface and having a length disposed between a first material end and a second material end and having a width disposed between a first material side and a second material side, said flexible material capable of reconfiguration between an unrolled and a rolled condition; and b) a fastener including:

i) a plurality of strips of loop material secured to said first material surface of said flexible material in substantially parallel laterally spaced apart relation between said first material side and said second material side of said flexible material, each loop material first end having a location proximate said first material end and each loop material second end having a location at one half a distance toward said second material end; and ii) a plurality of strips of hook material secured to said second material surface of said flexible material in substantially parallel spaced apart relation between said second material end and inward one half a distance toward said first material end of said flexible material, wherein mateable parts of said plurality of strips of hook material are capable of being fastened across one or more of said plurality of strips of loop material to fasten said first material surface of said flexible material to said second material surface of said flexible material in said rolled condition; and c) a releasably closable loop coupled to said first material surface of said flexible material proximate said second material end.

2. A garment carrier as described in claim 1, wherein each loop material first end having a location proximate said first material end and each loop material second end having a location at one half a distance toward said second material end; and wherein a plurality of strips of hook material secured to said second material surface of said flexible material in substantially parallel spaced apart relation between said second material end and inward one half a distance toward said first material end of said flexible material.

3. A garment carrier as described in claim 2, further comprising a handle coupled to said first material surface of said flexible material proximate said second material end.

4. A garment carrier as described in claim 3, wherein said handle comprises a flexible band having a band length disposed between a pair of band ends each coupled to said first material surface of said flexible material proximate said second material end said band length sufficient to define said handle opening through which said support element passes.

5. A garment carrier as described in claim 4, wherein said support element comprises a suitcase handle.

6. A garment carrier as described in claim 1, wherein said releaseably closable loop comprises:

a) a flexible member disposed between a first flexible member end and a second flexible member end said first flexible member end coupled to said first material surface of said flexible material proximate said second material end of said flexible material; and b) a loop closure having a first loop closure element coupled proximate said first flexible member end and a second loop closure element coupled proximate said second flexible member end, and wherein mateable parts of said first loop closure element and said second loop closure element fasten to generate a loop opening.

7. A garment carrier as described in claim 1, further comprising a shoulder strap having a length disposed between first strap end and a second strap end each coupled to said first material surface of said flexible material proximate said second material end.

8. A garment carrier as described in claim 1, wherein said plurality of strips of loop material and said plurality of strips of hook material are capable of engaging in perpendicular relation in the rolled condition of the flexible material to fasten said first material surface of said flexible material to said second material surface of said flexible material.

9. A garment carrier as described in claim 8, wherein said plurality of strips of loop material secured to said first surface of said flexible material in substantially parallel spaced apart relation between said first material side and said second material side of said flexible material each have a loop material length in a range of ten inches and twenty inches disposed between a first loop material end and a second loop material end and a loop material width in a range of three-quarters of an inch and two inches.

10. A garment carrier as described in claim 9, wherein said plurality of strips of hook material secured to said second material surface of said flexible material in substantially parallel spaced apart relation between said second material end and inward one half the distance toward said first material end of said flexible material have a loop material length equal to the distance between said first side and said second side of said flexible material and a hook material width in a range of three-quarters of an inch and two inches.

11. A garment carrier as described in claim 10, wherein said length of said flexible material disposed between said first material end and said second material end is twenty-eight inches, and wherein said width of said flexible material disposed between said first material side and said second material side is twenty one inches, and wherein said plurality of strips of loop material secured to said first material surface of said flexible material in substantially parallel spaced relation between said first material side and said second material side of said flexible material comprise four strips each having a loop material length of fifteen inches, and wherein each of said plurality of strips of loop material has a loop material width of one and one-half inches, and wherein each said first loop material end has a location within one inch of said first material end of said flexible material, and wherein said plurality of strips of hook material secured to said second material surface of said flexible material in substantially parallel spaced apart relation between said second material end and inward one half the distance toward said first material end comprise four strips of hook material each having a hook material length equal to the distance between the first material side and the second material side of said flexible material and a hook material width in a range of one and one-half inches.

12. A method of making a garment carrier, comprising the step of:

a) providing a flexible material having a thickness disposed between a first material surface and a second material surface and having a length disposed between a first material end and a second material end and having a width disposed between a first material side and a second material side, said flexible material capable of reconfiguration between an unrolled and a rolled condition; and b) providing a fastener including:

i) a plurality of strips of loop material secured to said first material surface of said flexible material in substantially parallel laterally spaced apart relation between said first material side and said second material side of said flexible material, each loop material first end having a location proximate said first material end and each loop material second end having a location at on half a distance toward said second material end; and ii) a plurality of strips of hook material secured to said second material surface of said flexible material in substantially parallel spaced apart relation between said second material end and inward one half the distance toward said first material end of said flexible material, wherein mateable parts of said plurality of strips of hook material are capable of being fastened across one or more of said plurality of strips of loop material to fasten said first material surface of said flexible material to said second material surface of said flexible material in said rolled condition; and a releasably closable loop coupled to said first material surface of said flexible material proximate said second material end.

13. A method of making a garment carrier as described in claim 12, wherein each loop material first end having a location proximate said first material end and each loop material second end having a location at one half a distance toward said second material end; and wherein a plurality of strips of hook material secured to said second material surface of said flexible material in substantially parallel spaced apart relation between said second material end and inward one half a distance toward said first material end of said flexible material.

14. A method of making a garment carrier as described in claim 13, further comprising the step of coupling a handle to said first material surface of said flexible material proximate said second material end.

15. A method of making a garment carrier as described in claim 14, wherein said step of coupling a handle to said first material surface of said flexible material proximate said second material end and said step of establishing an handle opening through which a support element passes comprises the step of providing a flexible band having a band length disposed between a pair of band ends each coupled to said first material surface of said flexible member proximate said second material end, wherein said band length of said flexible band is sufficient to define an handle opening through which a support element passes.

16. A method of making a garment carrier as described in claim 12, further comprising the step of coupling a releasably closable loop to said first material surface of said flexible material proximate said second material end.

17. A method of making a garment carrier as described in claim 16, wherein said step of coupling a releasably closable loop to said first material surface of said flexible material proximate said second material end comprises the steps of:

a) providing a flexible member disposed between a first flexible member end and a second flexible member end;

b) coupling said first flexible member end to said first material surface of said flexible material proximate said second material end; and c) providing a loop closure having a first loop closure element coupled proximate said first flexible member end and a second loop closure element coupled proximate said second flexible member end, and wherein mateable parts of said first loop closure element and said second loop closure element fasten to generate a loop opening.

18. A method of making a garment carrier as described in claim 12, further comprising the step of coupling a shoulder strap having a strap length disposed between first strap end and a second strap end to said first material surface of said flexible material proximate said second material end.

19. A method of making a garment carrier as described in claim 12, further comprising the step of securing said loop material to said first material surface of said flexible material proximate said first material end and securing said hook material to said second material surface of said flexible material proximate said second material end to allow mateable surfaces of said loop material and said hook material to engage in substantially perpendicular relation in the rolled condition of the flexible material to fasten said first material surface of said flexible material to said second material surface of said flexible material.

20. A method of making a garment carrier as described in claim 19, wherein said step of coupling a plurality of strips of loop material secured to said first material surface of said flexible material in substantially parallel spaced apart relation between a first material side and a second material side of said flexible material further comprises the step of providing a loop material length of said plurality of strips in a range of ten inches and twenty inches disposed between a first loop material end and a second loop material end and further providing a loop material width of said plurality of strips of loop material in a range of three-quarters of an inch and two inches.

21. A method of making a garment carrier as described in claim 20, wherein said step of coupling a plurality of strips of hook material to said second material surface of said flexible material in substantially parallel spaced apart relation between said second material end and inward one half said distance toward said first material end of said flexible material further comprises the step of providing a hook material length of said plurality of strips of hook material equal to the distance between said first material side and said second side of said flexible material and each of said plurality of strips of hook material having a hook material width in a range of three-quarters of an inch and two inches.

22. A method of making a garment carrier as described in claim 21, wherein said step of providing a flexible material disposed between a first material end and a second material end comprises the step of providing a flexible material having a material length of twenty-eight inches disposed between said first material end and said second material end and a material width of twenty one inches disposed between said first material side and said second material side, and wherein said plurality of strips of loop material secured to said first material surface of said flexible material in substantially parallel spaced apart relation between said first material side and said second material side of said flexible material comprise four strips each have a loop material length of fifteen inches disposed between a first loop material end and a second loop material end and a loop material width of one and one-half inches each said first loop material end having a location within one inch of said first end of said flexible material, and wherein said plurality of strips of hook material secured to said second material surface of said flexible material in substantially parallel spaced apart relation comprise four strips of hook material spaced three inches apart between said second material end and one half the distance to the first material end of the flexible material each having a hook material length equal to the distance between said first material side and said second material side of said flexible material and a material width of one and one-half inches.

* * * * *